US010793978B2

(12) United States Patent
Raisich et al.

(10) Patent No.: US 10,793,978 B2
(45) Date of Patent: Oct. 6, 2020

(54) WORKSTATION OF A TWO-FOR-ONE TWISTING OR CABLING MACHINE

(71) Applicant: Saurer Germany GmbH & Co. KG, Remscheid (DE)

(72) Inventors: Andrej Raisich, Kempten (DE); Jürgen Schnitzler, Viersen (DE)

(73) Assignee: SAURER TECHNOLOGIES GMBH & CO. KG, Krefeld (DE)

( * ) Notice: Subject to any disclaimer, the term of this patent is extended or adjusted under 35 U.S.C. 154(b) by 580 days.

(21) Appl. No.: 15/345,660

(22) Filed: Nov. 8, 2016

(65) Prior Publication Data

US 2017/0130368 A1 May 11, 2017

(30) Foreign Application Priority Data

Nov. 9, 2015 (DE) ..... 10 2015 014 382

(51) Int. Cl.

| | |
|---|---|
| ***D01H 7/86*** | (2006.01) |
| ***D01H 1/10*** | (2006.01) |
| ***D02G 3/28*** | (2006.01) |
| ***D01H 1/16*** | (2006.01) |
| ***D01H 1/244*** | (2006.01) |
| ***D01H 9/18*** | (2006.01) |

(52) U.S. Cl.

CPC ..... *D01H 7/86* (2013.01); *D01H 1/103* (2013.01); *D01H 1/106* (2013.01); *D01H 1/166* (2013.01); *D01H 1/244* (2013.01); *D01H 7/868* (2013.01); *D01H 9/18* (2013.01); *D02G 3/285* (2013.01); *D07B 2207/4009* (2013.01)

(58) Field of Classification Search

CPC ..... D01H 7/86; D01H 7/868; D01H 1/10; D01H 1/106

See application file for complete search history.

(56) References Cited

U.S. PATENT DOCUMENTS 4,685,285 A * 8/1987 Leonard ..... D01H 1/425 57/354
4,779,409 A * 10/1988 Marchiori ..... D01H 1/06 57/352

(Continued)

FOREIGN PATENT DOCUMENTS

DE 1 813 801 A1 7/1970
DE 37 39 175 A1 6/1988

(Continued)

*Primary Examiner* — Shaun R Hurley

(74) *Attorney, Agent, or Firm* — Nelson Mullins Riley & Scarborough LLP

(57) ABSTRACT

A workstation (1) of a two-for-one twisting or cabling machine which comprises a rotatably mounted spindle (2) and a balloon-yarn-guide-eye (9) height-adjustable by means of a drive (18, 29) coupled to a control device (20) which controls the drive (18, 29) in such a manner that it displaces the balloon-yarn-guide-eye (9) between operating positions ($AP_1$, $AP_2$) dependent upon production parameters and a resting position (RS) advantageous in the case of production interruptions and transient operating phases associated with the latter. A device (21, 23, 24, 25) is present for detecting a measured value (i), which is made available to the control device (20) and which causes the control of the drive (18, 29) to change the position of the balloon-yarn-guide-eye (9).

12 Claims, 8 Drawing Sheets

(56) References Cited

U.S. PATENT DOCUMENTS 4,848,075 A * 7/1989 Frentzel-Beyme .... B65H 57/06 57/264
4,951,456 A * 8/1990 Lucca ..... D01H 1/06 57/115
5,329,755 A * 7/1994 Frentzel-Beyme .... D01H 1/425 57/354
5,551,223 A * 9/1996 Nickolay ..... D01H 13/32 57/1 R
5,694,757 A * 12/1997 Smekal ..... D01H 1/24 57/100
6,009,698 A * 1/2000 Dinkelmann ..... D01H 13/04 57/264
6,332,312 B1 * 12/2001 Loscher ..... D01H 1/025 57/354
7,513,021 B1 * 4/2009 Haselwander ..... D01H 7/86 28/247
8,256,199 B2 * 9/2012 Schlagenhaft ..... D01H 1/10 57/264
10,196,761 B2 * 2/2019 Raisich ..... D01H 1/103
2011/0126506 A1 * 6/2011 Schlagenhaft ..... D01H 1/10 57/58.86
2011/0239617 A1 * 10/2011 Beckmann ..... D01H 1/106 57/58.83

FOREIGN PATENT DOCUMENTS

DE 37 08 331 C1 7/1988
DE 44 04 555 C1 6/1995
DE 44 02 582 A1 8/1995
DE 101 03 892 A1 8/2002
DE 10 2008 033 849 A1 1/2010
EP 1 071 837 B1 9/2002
EP 2 260 132 B1 1/2014
WO 2007090425 A1 8/2007

* cited by examiner

WORKSTATION OF A TWO-FOR-ONE TWISTING OR CABLING MACHINE

CROSS-REFERENCE TO RELATED APPLICATIONS

This application claims priority from German National Patent Application No. DE 10 2015 014 382.4, filed Nov. 9, 2015, entitled "Arbeitsstelle einer Doppeldrahtzwirn-oder Kabliermaschine", the entire contents of which are incorporated herein by reference.

FIELD OF THE INVENTION

The present invention relates to a workstation of a two-for-one twisting or cabling machine which comprises a rotatably mounted spindle and a balloon-yarn-guide-eye height-adjustable by means of a drive.

BACKGROUND OF THE INVENTION

Since a single yarn often cannot satisfy the requirements which are placed on it with regard to its strength and/or its uniformity during further processing or in the finished product, it is conventional in the textile industry to initiate a yarn finishing by twisting two or more yarns together. This textile process of yarn finishing is generally designated as yarn-twisting, wherein, however, a distinction is made between different types of yarn-twisting, for example, between two-for-one twisting and cabling.

In the case of two-for-one twisting, for example, two yarns are often connected to one another with an S or Z twist, wherein both yarns each receive an additional twist. By contrast, with the cabling method, a second yarn is wound around a feed yarn, wherein the twist of the single yarn remains substantially unchanged.

Furthermore, in the case of two-for-one twisting, there are different feed types with regard to the manner in which the yarns are supplied to the yarn-twisting machine. For example, the feed yarns can originate from a folded feed bobbin, which is mounted in a protective pot of the yarn-twisting spindle, or a feed yarn is unwound respectively from two feed bobbins arranged one above the other in the protective pot of the yarn-twisting spindle.

In the present application, the term yarns includes all linear structures, such as yarns, threads, foil strips, tubular and strip-shaped textiles and similar. By way of simplification, within the scope of this application, the term "yarn" is used for all possible alternative embodiments.

In the textile-machine industry, in the context of the finishing process of yarn-twisting, different embodiments of two-for-one twisting or cabling machines have also been known for a considerable time and described in detail in numerous patent specifications.

With all of these known two-for-one twisting or cabling machines, in each case in the region of each workstation, at least one running yarn in the form of a yarn balloon circulates around a yarn-twisting or cabling spindle, before it is wound onto a take-up bobbin by means of a winding device.

Since there is a risk of a yarn breakage occurring, especially in the case of friction-sensitive yarn materials, such as polypropylene, polyester or polyacrylic if the yarn balloon comes into contact with the stationary protective pot of the spindle during the yarn twisting or cabling process, it was initially conventional with such two-for-one twisting or cabling machines to adjust the diameter of the yarn balloon in such a manner that it is disposed safely above the diameter of the stationary protective pot.

However, since large yarn balloons are known to lead to relatively large ventilation losses and therefore to an increased energy requirement of the workstations of the two-for-one twisting or cabling machines, various attempts have already been made in the past, especially in conjunction with less friction-sensitive yarn materials, such as cotton, to reduce or respectively to limit the diameter of the yarn balloons.

For example, German Patent Publication DE 44 04 555 C1 describes two-for-one twisting spindles which comprise, in addition to a stationary protective pot accommodating the feed bobbin, a cylindrical balloon limiter surrounding the protective pot.

With two-for-one twisting spindles of this kind, the occurrence of a yarn balloon with a relatively large diameter is effectively prevented in that, after leaving the relatively large-diameter yarn discharge plate of the spindle, the yarn immediately runs against the inside of the balloon limiter.

In the case of a two-for-one yarn-twisting spindle according to German Patent Publication DE-OS 1 813 801, the feed bobbin is arranged, for example, not protected in a stationary protective pot, but is disposed openly on a component of the two-for-one yarn-twisting spindle constituted as a bobbin carrier. In order to avoid contact between the circulating yarn balloon supported externally on a cylindrical balloon limiter and the feed bobbin, a cylindrical yarn guide, arranged between the balloon limiter and the feed bobbin, which surrounds the feed bobbin at the height of the upper edge of the balloon limiter, is also provided in these known two-for-one yarn-twisting spindles.

However, the disadvantage with these known two-for-one yarn-twisting spindles is the relatively long physical contact of the circulating yarn balloon with the stationary balloon limiter.

Since the stresses acting on the yarn as a result of such stationary balloon limiters are relatively high, such two-for-one yarn-twisting spindles can be used only for relatively insensitive yarns.

It has therefore already been suggested that the size of the yarn balloon can be influenced by implementing controlling or regulating interventions with regard to the yarn tension of the yarn forming the yarn balloon in the workstations of two-for-one twisting or cabling machines.

Such two-for-one twisting or cabling machines, as described, for example in German Patent Publication DE 10 2008 033 849 A1, conventionally comprise a plurality of generally identically constituted workstations arranged side-by-side, wherein the workstations each comprise a stationary protective pot for the accommodation of at least one feed bobbin, a yarn-twisting or cabling spindle and a device for influencing the yarn tension.

With a workstation which operates according to the two-for-one twisting method, for example, a single or multiply folded yarn is withdrawn upwards from a feed bobbin arranged in the protective pot and introduced into the upper end of the hollow bobbin axle of the yarn-twisting spindle via a controllable yarn-supply unit arranged on the bobbin axle of the yarn-twisting spindle.

That is, the folded yarn is deflected downwards in the yarn-supply unit and extends to a rotatably mounted, driveable yarn-twist-providing element arranged below the protective pot, which is constituted, for example, as a so-called yarn-twisting plate. The running, folded yarn leaves the yarn-twisting plate, which can be constituted, for example, as a discharge plate with storage disk, via a radial opening arranged in the yarn-twisting plate and is then guided to a stationary balloon-yarn-guide-eye arranged above the protective pot. In this context, because of the rotation of the yarn-twisting plate, the folded yarn forms a yarn balloon rotating around the protective pot between the yarn-twisting plate and the balloon-yarn-guide-eye arranged above the protective pot, wherein the size of the yarn balloon set during the yarn-twisting process can be adjusted by the yarn-supply unit.

In the case of a workstation which operates according to the cabling method, two separately arranged feed bobbins are used. Accordingly, a first feed bobbin is positioned conventionally in a protective pot of the workstation, while a second feed bobbin is arranged in an associated bobbin rack.

From this feed bobbin stored in the bobbin rack, a so-called outer yarn is withdrawn by a yarn-supply unit controllable in a defined manner, and introduced from below into the hollow bobbin axle of a driveable yarn-twist-providing element mounted in a rotatable manner, which is constituted, for example, as a yarn-twisting plate.

The running outer yarn leaves the storage disk via a radial opening and is then guided, for example, over the yarn-twisting plate to a stationary balloon-yarn-guide-eye arranged above the protective pot.

In this context, because of the rotation of the yarn-twisting plate, the outer yarn also forms, between the yarn-twisting plate and the balloon-yarn-guide-eye arranged above the protective pot, a yarn balloon rotating around the protective pot, wherein the size of the yarn balloon set during the yarn-twisting process can be adjusted by the yarn-supply unit.

After passing the balloon-yarn-guide-eye, the twisted or also the cabled yarn is wound by a spooling device onto a take-up bobbin.

In the case of the workstations of the two-for-one twisting or cabling machines described above, in which the height of the circulating yarn balloon is limited in each case by a balloon-yarn-guide or respectively a balloon-yarn-guide-eye, it is often not possible or respectively at least extremely difficult to implement variations in the height of the yarn balloon during the operation of the workstation.

However, textile equipment is known in the textile-machine industry in which the height of the yarn balloon is adjustable.

For example, in German Patent Publication DE 37 39 175 A1, a bobbin rack is described, in which the running behaviour of the feed bobbins is optimised in that the distance between the relevant feed bobbin and an associated balloon-yarn-guide is varied constantly during operation, in each case, dependent upon the weight of the feed bobbin.

This means that, with this known bobbin rack, either the feed bobbins or the balloon-yarn-guide-eyes are mounted in a movable manner.

The height adjustment of the balloon-yarn-guide-eye is also mentioned in German Patent Publication DE 10 103 892 A1. However, this literature reference describes a method and a device with which the rate of yarn withdrawal from feed bobbins arranged in the rack of a warping machine is to be optimised.

Textile machines with balloon-yarn-guides or more specifically balloon-yarn-guide-eyes mounted in a movable manner are also known in the context of ring-spinning machines.

For example, German Patent Publication DE 44 02 582 A1 describes a ring-spinning machine of which the balloon-yarn-guides are mounted in a height-adjustable manner, as is conventional with such textile machines. This means that the ring-spinning machine comprises several machine rails arranged, in each case, one above the other on both of its longitudinal machine sides, wherein, as known, further machine rails mounted in a vertically movable manner are installed above a stationary spindle rail. In this context, the balloon-yarn-guides of the numerous workstations of the ring-spinning machine are arranged on the uppermost of these machine rails, mounted in a vertically movable manner. With such an arrangement, all of the balloon-yarn-guides on one side of the machine are displaced together during the spinning operation; a separate control of the balloon-yarn-guide of an individual workstation is not possible.

In the case of the ring-spinning machine according to European Patent Publication EP 1 071 837 B1, a comparable arrangement is given, however, the balloon-yarn-guides here are additionally tiltable and arranged on their vertically displaceable machine rail. Such a tiltable arrangement of the balloon-yarn-guides improves the access to the ring-spinning spindles, and therefore considerably facilitates the automation of the bobbin changing process of the ring-spinning machine.

European Patent Publication EP 2 260 132 B1 describes a yarn-twisting or cabling machine of which the workstations are each fitted with a vertically adjustable yarn balloon guide. With this known textile machine, the rate of production of the workstations is supposed to be increased through corresponding positioning of the yarn balloon guide, wherein the yarn quality is to be maintained. This reference in the literature contains no indications regarding the manner and means of the positioning of the yarn balloon guide.

SUMMARY OF THE INVENTION

Starting from the prior art named above, the invention is based upon the object of providing a workstation of a two-for-one twisting or cabling machine which is constituted in such a manner that the balloon-yarn-guide-eye of a workstation height-adjustable by a drive can always be positioned in an optimal operating position.

This object is addressed according to the invention in that the drive is coupled to a control device which controls the drive in such a manner that it displaces the balloon-yarn-guide-eye between operating positions dependent upon production parameters and a resting position advantageous in the case of production interruptions and transient operating phases associated with the latter, and that a device for detecting a measured value is present, which is made available to the control device and which causes the control of the drive to change the position of the balloon-yarn-guide-eye.

Advantageous embodiments of the device according to the invention are described more fully hereinafter.

The device according to the invention has the particular advantage that during the operation of the workstation, it is ensured at all times that the balloon-yarn-guide-eye is always positioned advantageously. That is, dependent upon a measured value which is provided by an associated device, a control device immediately ensures that the drive positions the balloon-yarn-guide-eye in an optimal operating position in each case. For example, in the case of interruptions of production, the balloon-yarn-guide-eye is positioned in a resting position in which the spindle of the workstation is readily accessible for operating personnel.

In a first advantageous embodiment, it is further provided that the device for detecting a measured value is a measuring device, which monitors the energy consumption of the spindle drive during the operation of the workstation.

That is, by means of a measuring device, the current which is consumed by the spindle drive is detected, and a measured value is generated from this which allows inferences about the momentary operating condition of the workstation, especially the size of the yarn balloon and accordingly the position of the balloon-yarn-guide-eye.

This means that, by measuring the output or respectively the torque of the drive unit of the spindle, the measuring device produces a measured value which can be used by the control device to position the balloon-yarn-guide-eye advantageously by means of an associated drive.

However, the measuring device for detecting a measured value capable of being processed by a control device can also comprise different embodiments.

For example, a time-measuring device can also be used, which provides a measured value, for example, after a given time span which the workstation requires in order to speed up again to an operating speed after a standstill, which the control device processes in such a manner that the drive is caused to displace the balloon-yarn-guide-eye out of a resting position into an operating position.

In a further advantageous embodiment, the device for detecting a measured value can also be constituted as a sensor device which detects the size of a yarn balloon circulating around the spindle during the operation of the workstation. In this context, the sensor device is constituted, for example, as a light barrier, which comprises a light source and a light receiver and which scans the circulating yarn balloon with a light beam.

With such a sensor device, the yarn forming the yarn balloon generates, with every circulation, by shading the light beam, a signal, which is processed by the sensor device to form a measured value and rerouted to the control device.

However, a yarn-tension sensor can also be used as the unit for detecting a measured value, which is arranged in the region of the yarn pathway of a twisted or cabled yarn, preferably between the resting position of the balloon-yarn-guide-eye and a yarn-supply unit disposed upstream of the winding device.

Such a yarn-tension sensor connected to the control device is also capable of generating from the measured yarn tension a measured value, on the basis of which the control device causes the drive of the balloon-yarn-guide-eye to position the balloon-yarn-guide-eye of the workstation optimally.

In an advantageous embodiment, each of the workstations of the two-for-one twisting or cabling machine is further provided with a controllable yarn-tension influencing device, which is preferably constituted as a yarn-supply unit or as a yarn brake.

Both with a yarn-supply unit and also with a yarn brake, the yarn tension of a circulating yarn balloon can be adjusted very precisely, that is, such a controllable yarn-tension influencing device, in conjunction with an advantageous operating position of the balloon-yarn-guide-eye, allows an optimisation of the size and the shape of the circulating yarn balloon at all times, and accordingly, a significant reduction in the energy requirement of the relevant workstation.

In an advantageous embodiment, the control device is further constituted in such a manner that, during the operation of the workstation, together with the yarn-tension-influencing device, it ensures that the balloon-yarn-guide-eye is displaced out of a first operating position into a second operating position in order to reduce the energy consumption of the spindle drive, wherein the second operating position of the balloon-yarn-guide-eye is preferably arranged between the first operating position and the resting position of the balloon-yarn-guide-eye.

By preference, the control device is constituted in such a manner that signals which are related to a given event in the relevant workstation, for example, spindle start, yarn breakage, end of running period or batch change, are used immediately for a defined control of the drive of the balloon-yarn-guide-eye and accordingly for an advantageous positioning in a resting position or an operating position. Through the embodiment of the control device, it is therefore ensured at all times during the operation of the workstation that the balloon-yarn-guide-eye is positioned advantageously.

This means that, through the control device, dependent upon a measured value which is provided by an associated device, and which relates to a given event in the relevant workstation, it is always immediately guaranteed that a drive positions the balloon-yarn-guide-eye optimally corresponding to the event.

BRIEF DESCRIPTION OF THE DRAWINGS

Further details of the invention are described in the following with reference to exemplary embodiments illustrated in the drawings which show.

DETAILED DESCRIPTION OF THE INVENTION

Figure 1:
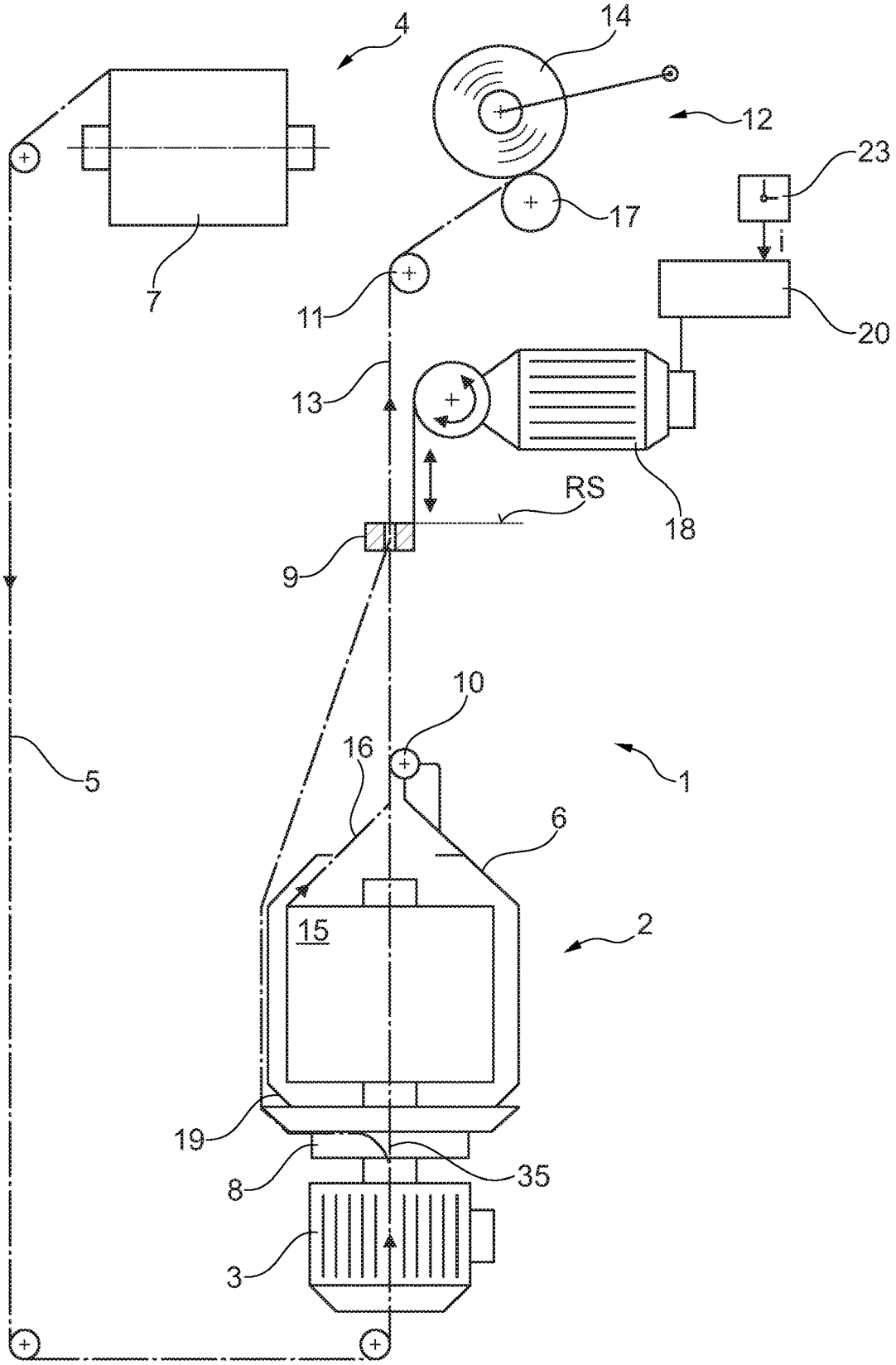
FIG. 1 schematically depicts, in lateral view, a workstation of a cabling machine, with a balloon-yarn-guide-eye according to the invention, height-adjustable by means of a drive, positioned in a resting position, wherein a control device is connected to the drive of the balloon-yarn-guide-eye, which is connected to a time-measuring device; the workstation is disposed at a standstill.

FIG. 1 shows schematically, in lateral view a workstation 1 of a cabling machine with a balloon-yarn-guide-eye 9 which can be height adjusted by a drive 18. The drive 18 is connected to a control device 20. The workstation 1 is disposed at a standstill, that is, the spindle drive 3 is switched off; the spindle 2 does not rotate.

As suggested in FIG. 1, a bobbin rack 4 (not illustrated in greater detail), which generally serves to accommodate a plurality of feed bobbins 7, is positioned above or behind the workstation 1.

A so-called outer yarn 5 is withdrawn from at least one of these feed bobbins 7 referred to in the following as a first feed bobbin 7.

As is evident, the outer yarn 5 withdrawn from the first feed bobbin 7 is deflected several times before it enters the hollow rotary axle of the spindle drive 3 in the region of a rotational axis 35 of the spindle 2.

The outer yarn 5 leaves the hollow rotary axle of the spindle drive 3 through a so-called yarn discharge borehole facing radially outwards, arranged somewhat below a protective pot 19 and reaches the external region of a yarn-deflection device 8.

In the region of the yarn-deflection device 8, the outer yarn 5 is deflected upwards and reaches a balloon-yarn-guide-eye 9 where it meets an inner yarn 16.

In the case of a standstill of the spindle, the outer yarn 5 is disposed, as illustrated in FIG. 1, against the outer wall of the protective pot 19.

As already suggested above, the workstation 1 comprises a rotatably mounted spindle 2 and a yarn-deflection device 8, which rotates around a rotational axis 35.

A protective pot 19, which comprises a hood 6 with a yarn brake 10, is arranged on the yarn-deflection device 8. A second feed bobbin 15 is mounted in the protective pot 19, from which the so-called inner yarn 16 is withdrawn overhead, which extends via the yarn brake 10 to the balloon-yarn-guide-eye 9 arranged above the spindle 2, where it contacts the outer yarn 5.

Figure 8:
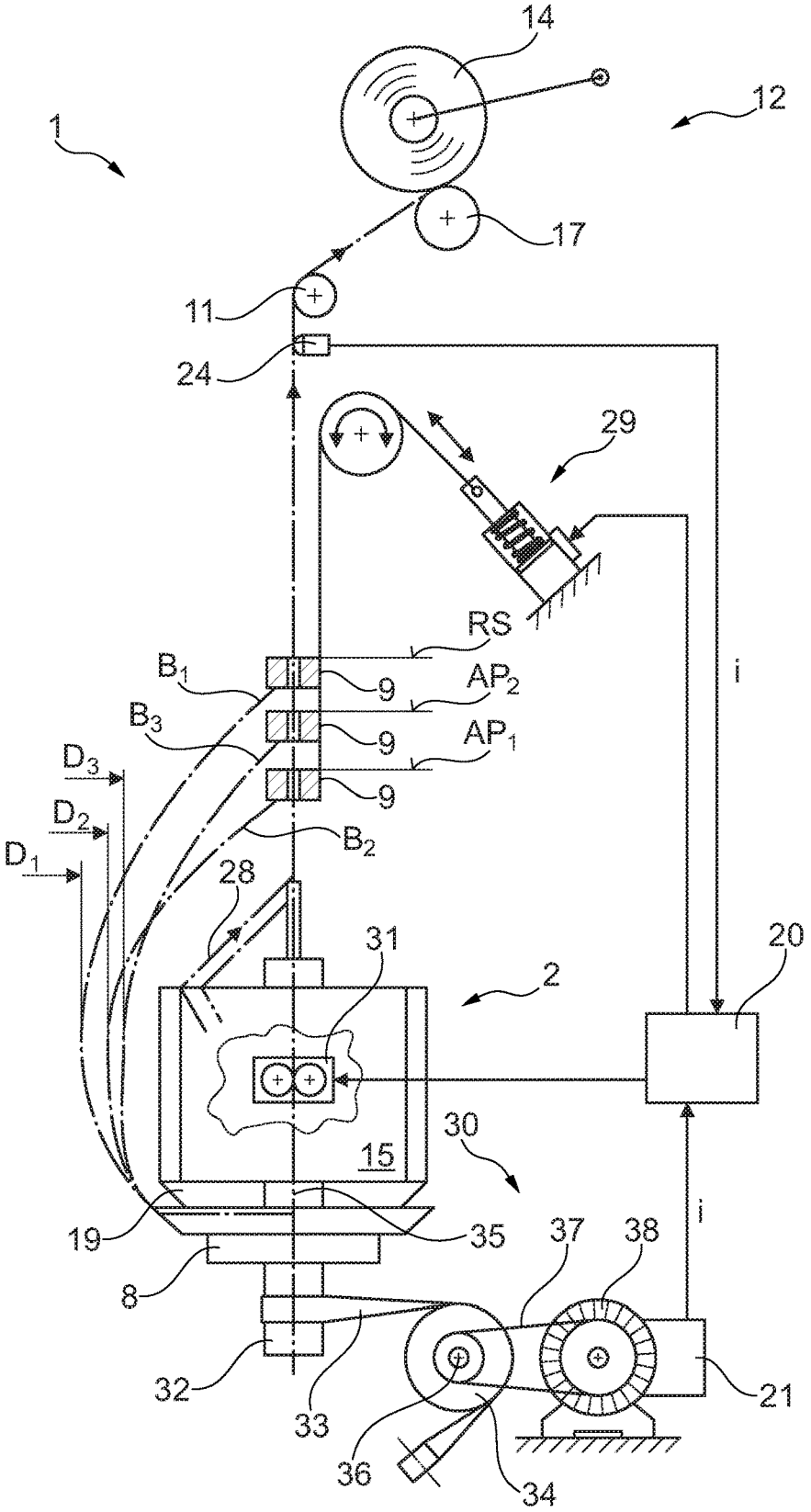
FIG. 8 schematically, in lateral view, a workstation of a two-for-one twisting machine with a balloon-yarn-guide-eye height-adjustable by means of a drive, wherein the drive is connected to a control device, to which a yarn-tension sensor and a yarn-supply unit are further connected.

The protective pot 19 which accommodates the second feed bobbin 15 and which is mounted on the rotatable yarn-deflection device 8 is protected against rotation, preferably by a magnetic device (not illustrated). The rotatably mounted yarn-deflection device 8 of the spindle 2 is charged with drive. That is, either a direct drive in the form of a spindle drive 3, as in the present exemplary embodiment, or an indirect drive device, as illustrated for example in FIG. 8, is provided.

The yarns (outer yarn 5 and inner yarn 16) meeting in the balloon-yarn-guide-eye 9 arrive, via a yarn-conveying device 11, at a spooling and winding device 12, where they are wound onto a take-up bobbin 14.

That is, the yarns 5 and 16 cabled in a running operating process in the region of the balloon-yarn-guide-eye 9, for example, to form a corded yarn 13, are wound on the spooling and winding device 12 to form a take-up bobbin 14, which is constituted, for example, as a cross-wound bobbin. In this context, twisted, cabled or high-twist yarns are understood as corded yarns.

For this purpose, the spooling and winding device 12 provides, inter alia, a drive roller 17, which drives the take-up bobbin 14 during the operating process via friction drive.

As shown schematically in FIG. 1, the balloon-yarn-guide-eye 9 is mounted in a vertically displaceable manner and connected to a drive 18, which, for its part, is connected to a control device 20, which is connected to a time-measuring device 23. The control device 20 ensures that, when the workstation 1 is at a standstill, the drive 18 positions the balloon-yarn-guide-eye 9 in a resting position RS in which the balloon-yarn-guide-eye 9 is somewhat raised. That is, the balloon-yarn-guide-eye 9 is positioned in such a manner that a relatively large distance is given between the balloon-yarn-guide-eye 9 and the hood 6 of the protective pot 19, which has a positive influence on the accessibility of the spindle 2 or respectively of the protective pot 19.

Figure 2:
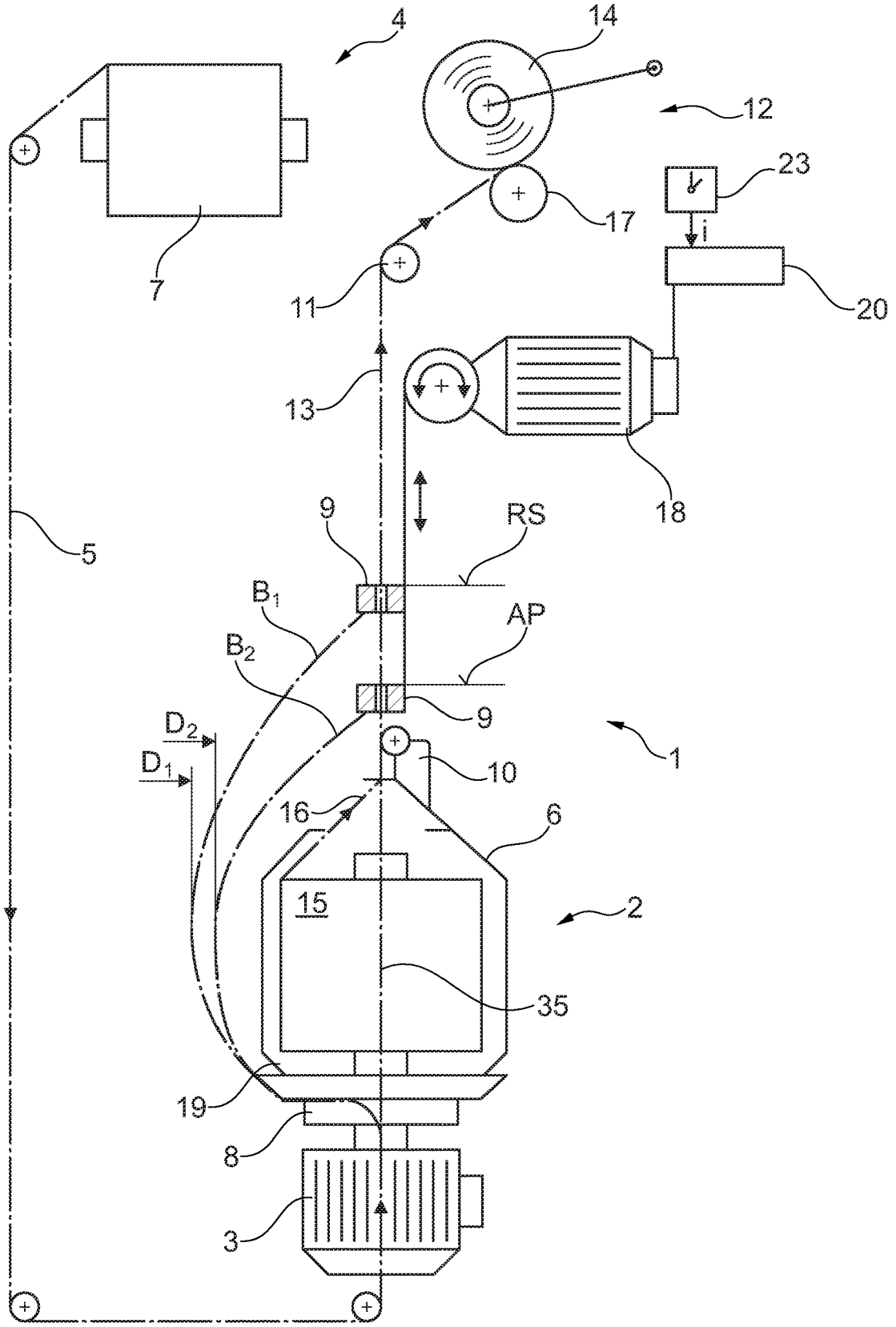
FIG. 2 depicts the workstation according to FIG. 1 during operation, wherein the balloon-yarn-guide-eye has been lowered from a resting position into an operating position.

FIG. 2 shows the workstation 1 described above during operation, that is, for example, while a corded yarn 13 is cabled on the workstation.

As already explained in connection with FIG. 1, an outer yarn 5 which is deflected several times, is withdrawn from a first feed bobbin 7 arranged in a bobbin rack 4, which enters the hollow rotary axle of the spindle drive 3 in the region of the rotational axis 35 of the spindle 2.

As already known, the outer yarn 5 leaves the hollow rotary axle of the spindle drive 3 through a so-called yarn discharge borehole facing radially outwards, arranged somewhat below a protective pot 19, which is a component of a rotating yarn-deflection device 8.

On leaving the yarn-deflection device 8, the running outer yarn 5 is deflected upwards and extends, with the formation of a yarn balloon B, of which the shape and size is predetermined, inter alia, by the position of the balloon-yarn-guide-eye 9, and which circulates around a protective pot 19 up to the balloon-yarn-guide-eye 9, where it meets the inner yarn 16, which is simultaneously withdrawn overhead from a second feed bobbin 15, which is mounted in a protective pot 19 of the spindle 2. In the region of the balloon-yarn-guide-eye 9, the outer yarn 5 and the inner yarn 16 are cabled to form a corded yarn 13, which is transported by the yarn-conveying device 11 to the spooling and winding device 12 and wound there to form a take-up bobbin 14.

At the start of the operating process, the balloon-yarn-guide-eye 9, vertically adjustable by means of a drive 18, is initially positioned in a resting position RS. The yarn balloon B1 then comprises a relatively large height and a relatively large diameter D1. In terms of atmospheric friction, such an embodiment is very unfavourable and leads to a relatively high energy demand of the spindle drive 3.

A control device 20 connected to the drive 18 of the balloon-yarn-guide-eye 9, which is connected to a time-measuring device 23, accordingly ensures that the balloon-yarn-guide-eye 9 is lowered, as soon as the spindle 2 has reached its operating speed or before the spindle 2 reaches its operating speed, to an operating position AP in which the yarn balloon B2 comprises a significantly reduced height and also a significantly smaller diameter D2. In this manner, it is possible to reduce the energy demand of the spindle drive 3 of the workstation 1 significantly.

The time required by the spindle 2 to reach its operating speed is monitored by means of the time-measuring device 23. This means that the time-measuring device 23 makes available to the control circuit 20 a measured value i which the latter uses for controlling the drive 18. However, the time-measuring device 23 can also operate with a rigidly fixed value, after the expiry of which it makes a measured value i available to the control circuit 20.

Figure 3:
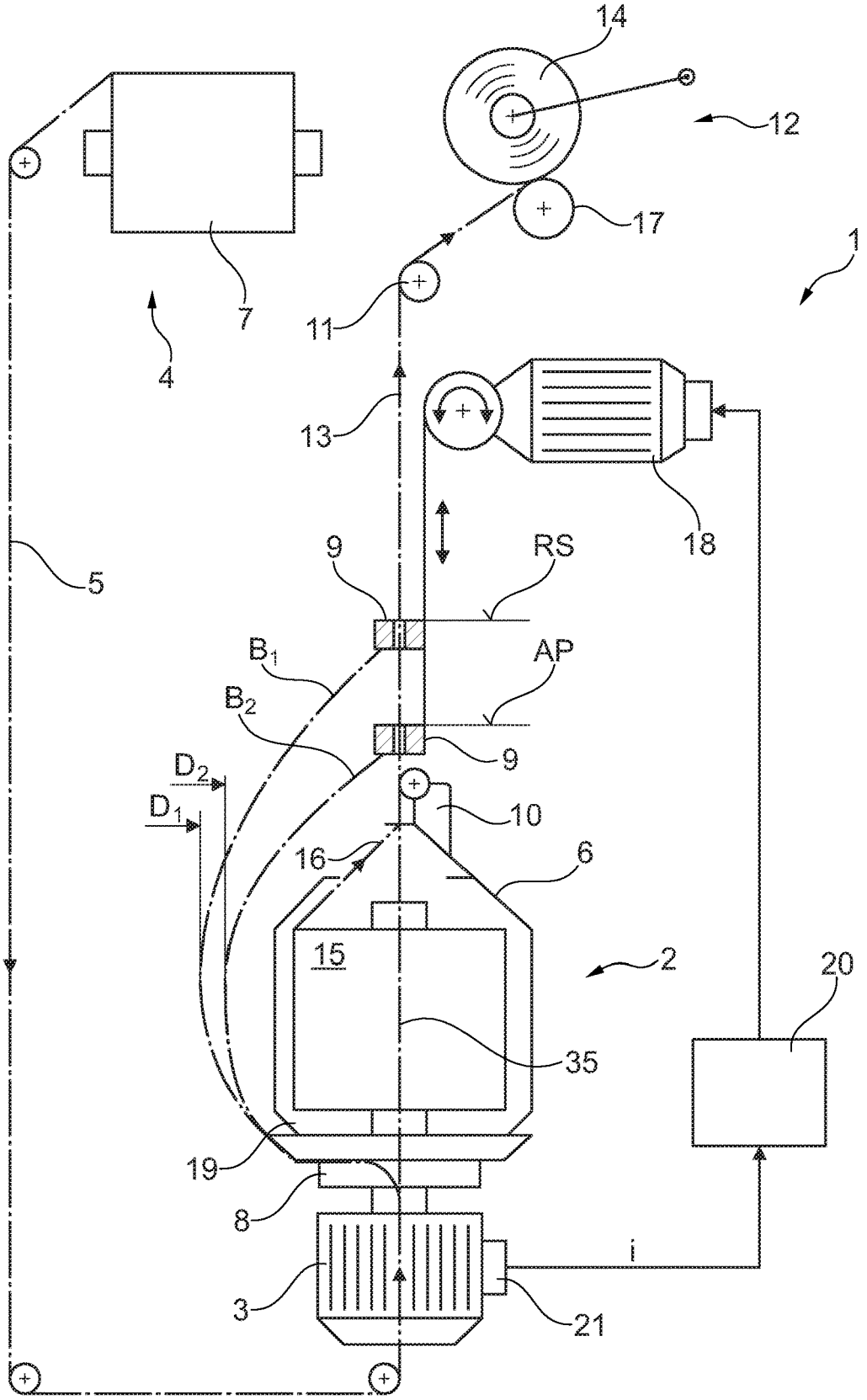
FIG. 3 depicts a second embodiment of a workstation of a cabling machine with a control device connected to the drive of the balloon-yarn-guide-eye and a device which monitors the energy consumption of the spindle drive during the operation of the workstation.

The embodiment of a workstation 1 of a cabling machine illustrated in FIG. 3 differs in its constructive embodiment only slightly from the embodiment described above with reference to FIGS. 1 and 2. The following description of FIG. 3 is therefore substantially restricted to a brief explanation of the differences.

With the embodiment shown in FIG. 3, the drive 18 is coupled, for the positioning of the balloon-yarn-guide-eye 9, to a control device 20, which, for its part, is connected to a device for detecting a measured value, which is a measuring device 21 in the illustrated embodiment, which monitors the energy consumption of the spindle drive 3 during the operation of the workstation 1.

This means that the measuring device 21 makes available to the control device 20 a measured value i, which the control device 20 uses for controlling the drive 18 when the spindle 2 has reached its operating speed and, correspondingly, the energy consumption of the spindle drive 3 has reached a given level.

For example, the drive 18 is controlled in such a manner that it displaces the balloon-yarn-guide-eye 9 out of its resting position RS into its operating position AP, in which the yarn balloon B2 comprises a significantly lower height and also a significantly reduced diameter D2. In this manner, it is possible to reduce the energy demand of the spindle drive 3 of the workstation 1 significantly.

Figure 4:
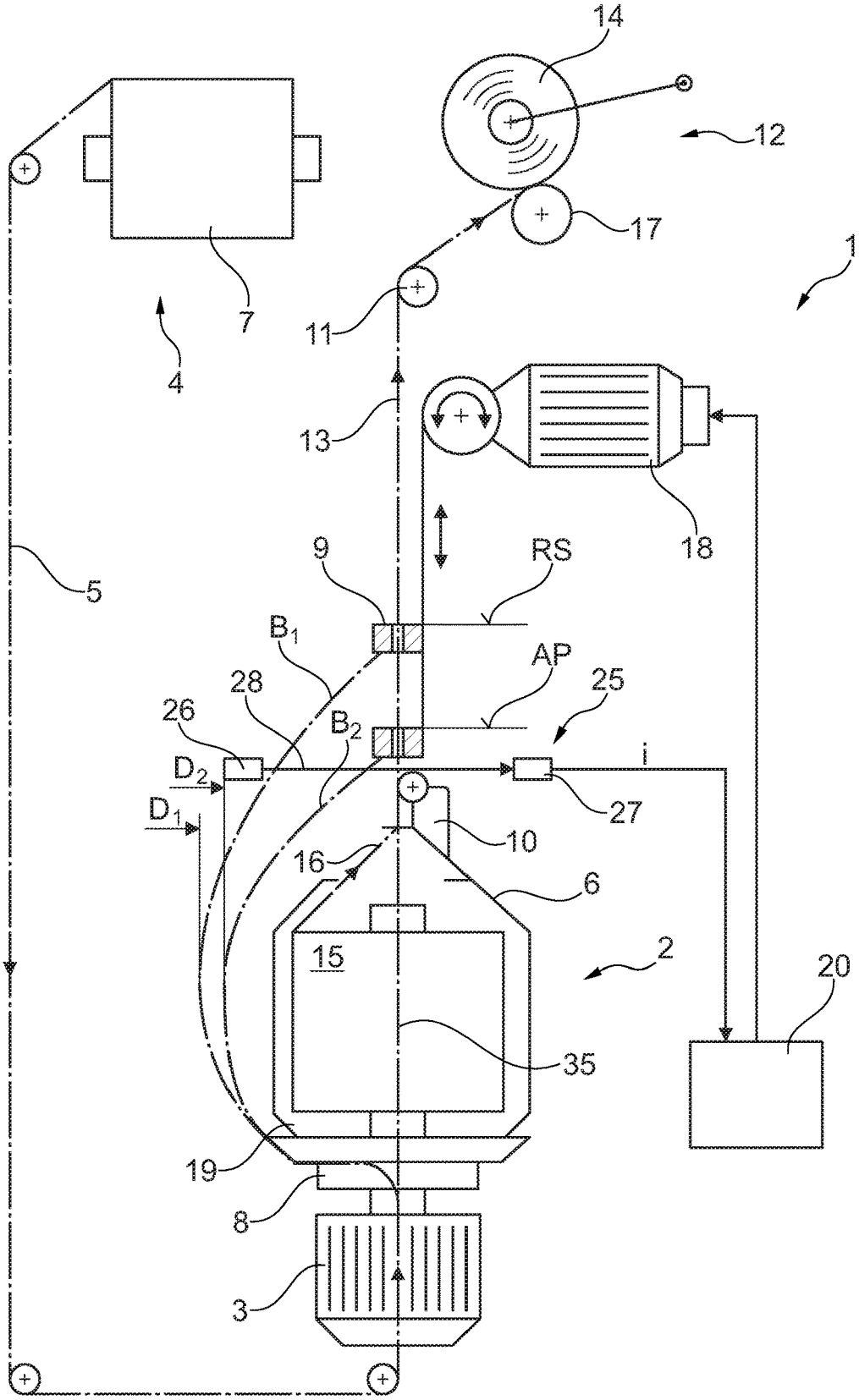
FIG. 4 depicts a further embodiment of a workstation of a cabling machine with a control device connected to the drive of the balloon-yarn-guide-eye and a sensor device constituted as a light barrier, which monitors the diameter of a circulating yarn balloon during the operation of the workstation.
Figure 5:
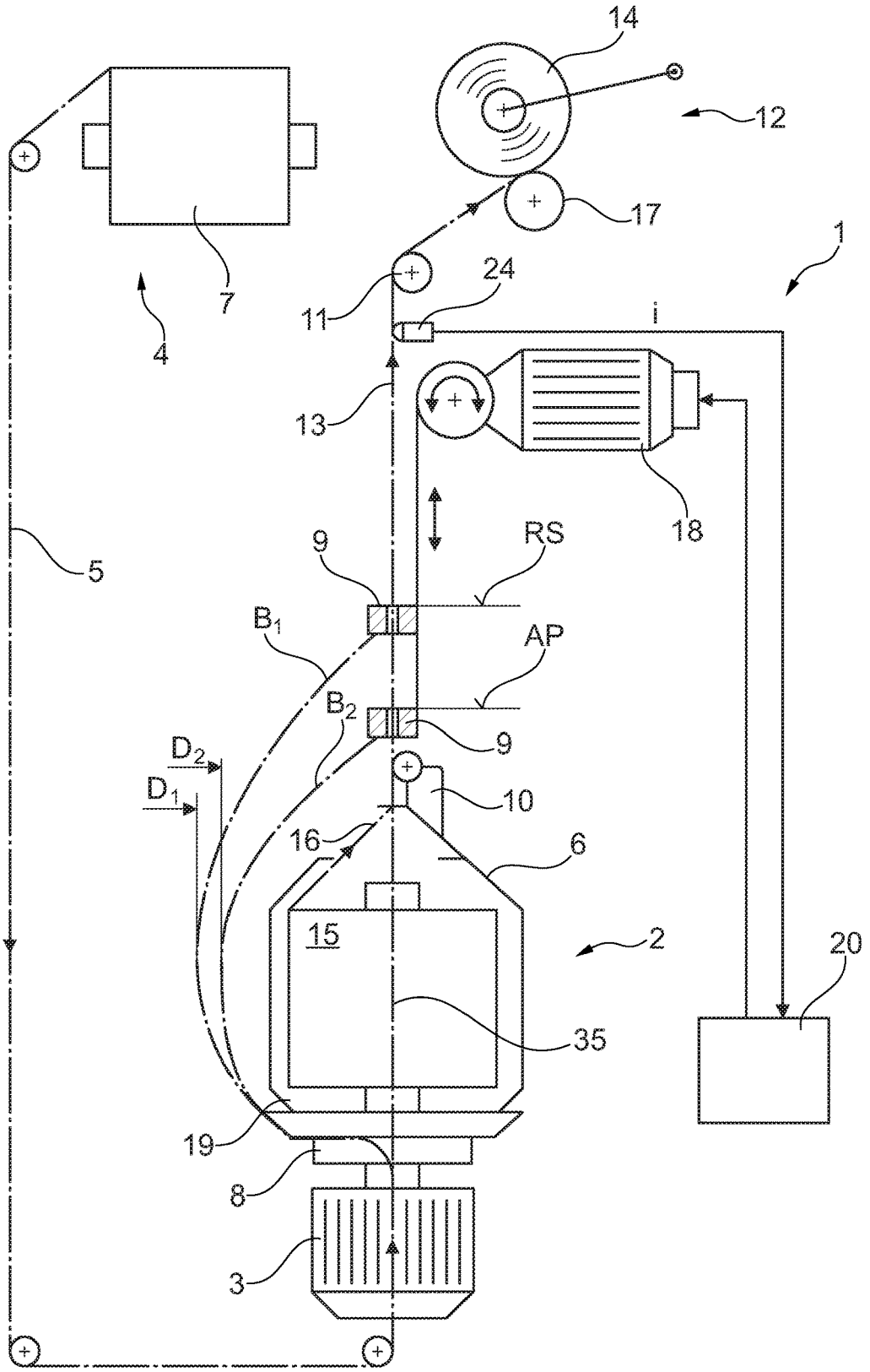
FIG. 5 a third embodiment of a workstation of a cabling machine with a control device connected to the drive of the balloon-yarn-guide-eye and a yarn-tension sensor for monitoring the yarn tension, for example, of a corded yarn.

The embodiments of a workstation 1 of a cabling machine illustrated in FIGS. 4 and 5 differ from the workstation shown in FIG. 3 only with regard to the constitution of their devices for detecting a measured value i.

In the case of the embodiment according to FIG. 4, the device for detecting a measured value i is a sensor device 25, which is constituted as a light barrier, that is, comprises a light source 26 and a light receiver 27.

Such optically operating light barriers were shaded by the circulating yarn of the yarn balloon B, in the exemplary embodiment, the outer yarn 5 originating from the first feed bobbin 7, intermittently shades a light beam 28 with every circulation of the yarn balloon B, which allows inferences regarding the momentary rotational speed of the spindle 2 and regarding the size of the yarn balloon B.

With such a sensor device 25 formed as a light barrier connected to the control device 20, not only can the diameter of the yarn balloon B therefore be determined, but the rotational speed of the spindle 2 can also be monitored relatively simply, and a measured value i can be communicated to the control device 20 when the operating speed has been reached. The control device 20 then ensures that the drive 18 is optimized the balloon-yarn-guide-eye 9 with regard to its position, that is, the drive 18 transfers the balloon-yarn-guide-eye 9 out of its resting position RS into the operating position AP.

In the case of the embodiment according to FIG. 5, the device for detecting a measured value i is a yarn-tension sensor 24, which is arranged in the yarn course of a corded yarn 13 shortly before the spooling and winding device 12.

With such a yarn-tension sensor 24, the yarn tension of the corded yarn 13 is monitored, and a measured value i is generated when the yarn tension reaches a specified threshold value.

When it receives such a measured value i, the control device 20 then ensures, as is conventional, that the drive 18 transfers the balloon-yarn-guide-eye 9 into the operating position AP, which leads to a smaller yarn balloon and accordingly to a reduction of the yarn tension.

Figure 6:
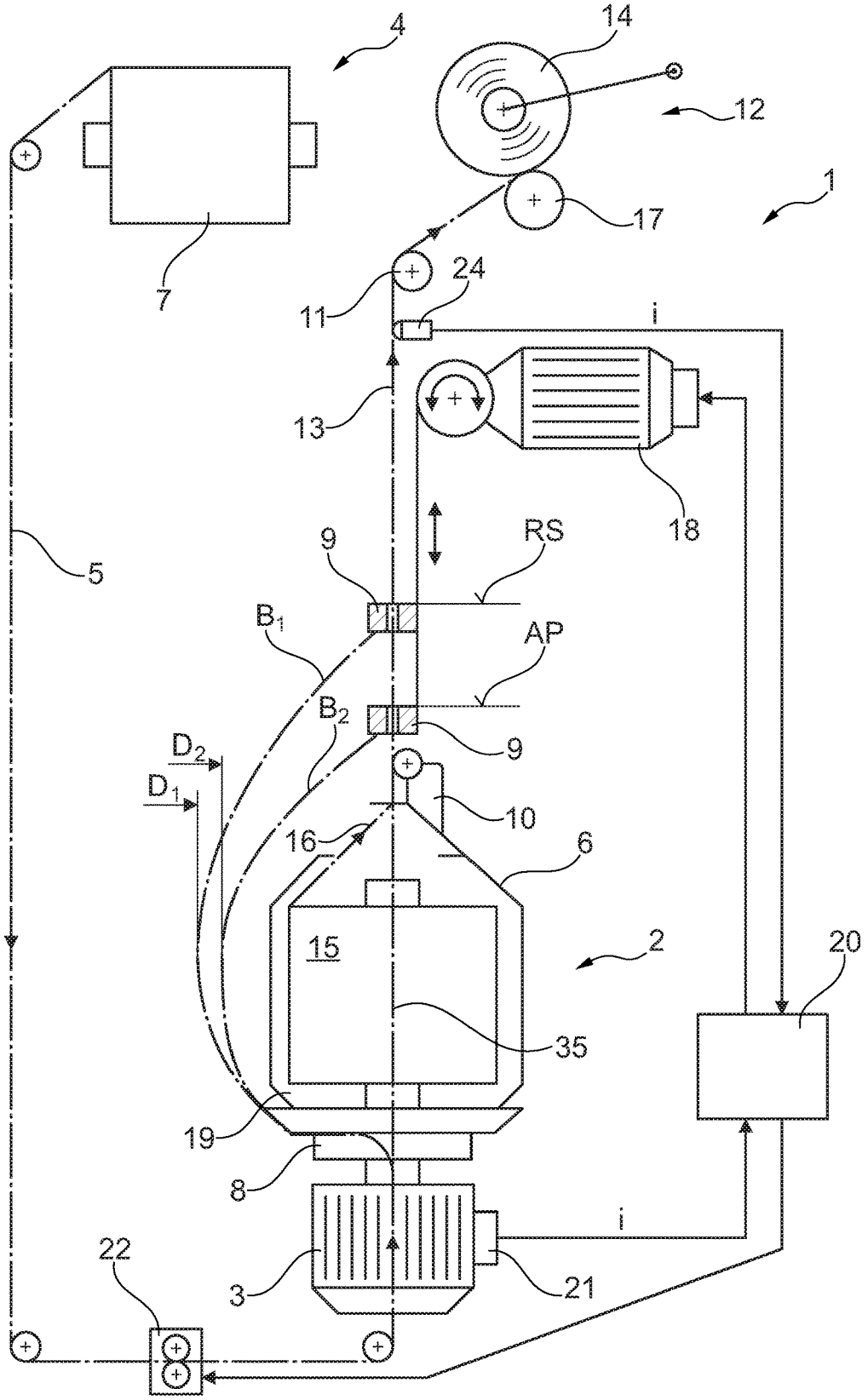
FIG. 6 a workstation of a cabling machine with a control device connected to the drive of the balloon-yarn-guide-eye, with devices for the provision of measured values which the control device processes in order to position the balloon-yarn-guide-eye and with a yarn-supply unit for the outer yarn connected to the control device.

FIG. 6 shows a workstation 1 of a cabling machine which comprises a control device 20 connected to the drive 18 for the balloon-yarn-guide-eye 9, various devices for detecting a measured value i and a yarn-tension influencing device 22 connected in the yarn pathway of the outer yarn 5.

By preference, one of the devices for detecting a measured value i connected to the control device 20 is a measuring device 21, which, as already explained with reference to FIG. 3, monitors the energy consumption of the spindle drive 3 during the operation of the workstation 1. In the exemplary embodiment of FIG. 6, a yarn-tension sensor 24, which scans the corded yarn 13 and is installed, for example, just below a yarn-conveying device 11, is also used as a further device for detecting a measured value i.

In this context, the yarn-tension influencing device 22 connected in the yarn pathway of the outer yarn 5 is, for example, a controllable yarn-supply unit or a controllable yarn brake.

An embodiment of a workstation 1 as described above guarantees that the control device 20 always ensures that the drive 18 positions the balloon-yarn-guide-eye 9 advantageously at all times and also ensures that the yarn-tension influencing device 22 keeps the yarn tension of the yarn balloon B2 at an optimal value dependent upon the measured values i of the devices 21 and/or 24.

Figure 7:
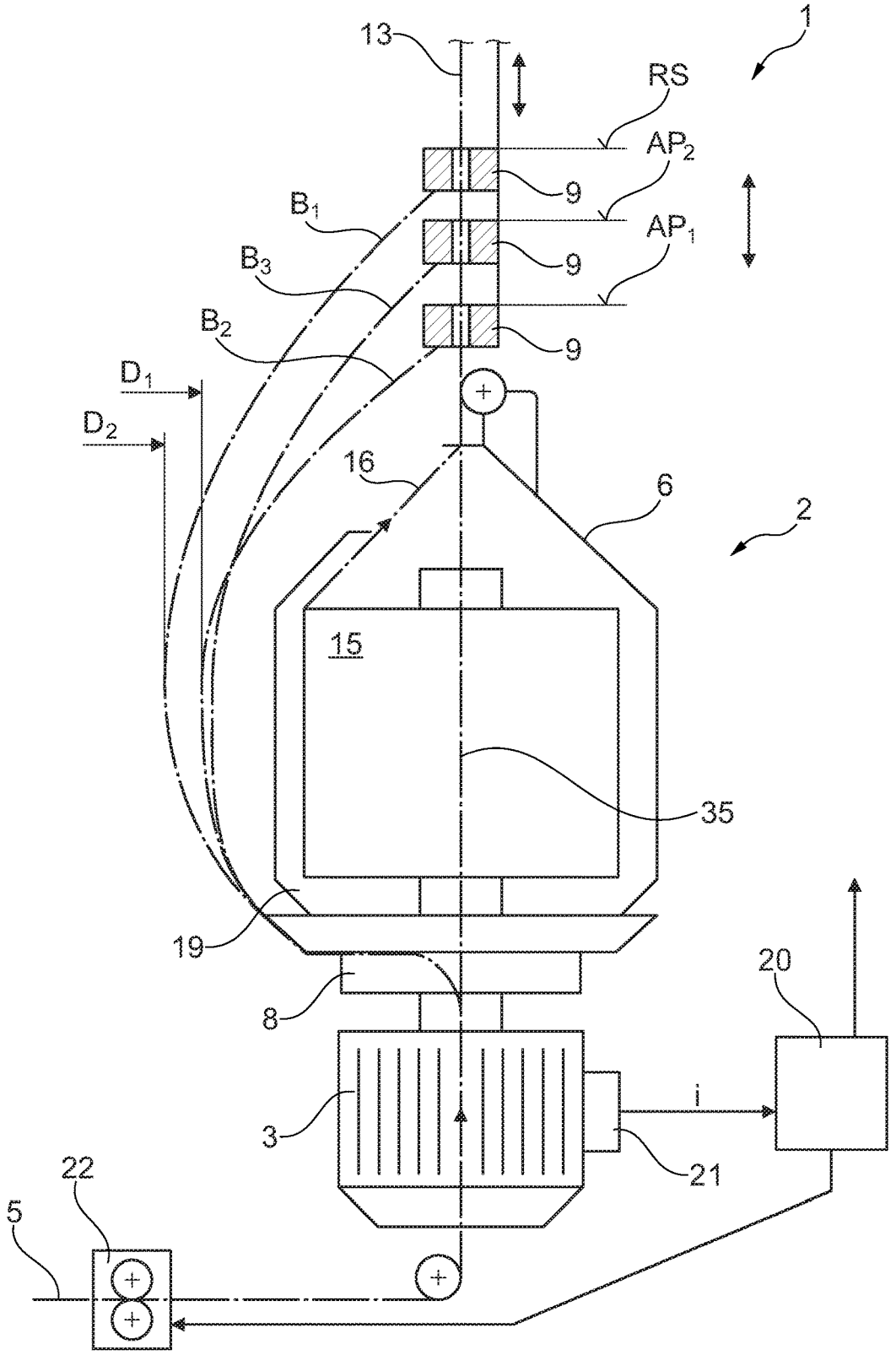
FIG. 7 a workstation with a control device which allows a defined displacement of the balloon-yarn-guide-eye from a first into a second operating position.

FIG. 7 shows a workstation 1 of a cabling machine in a somewhat larger scale.

As is evident, with this workstation 1, the balloon-yarn-guide-eye 9 can be displaced between a resting position RS, advantageous in the case of interruptions in production, and first or respectively second operating positions $AP_1$, $AP_2$ dependent upon spinning parameters, and associated transient operating phases.

That is, the control device 20 is constituted in such a manner that, dependent upon a measured value i provided, for example, by a measuring device 21, the drive 18 for the balloon-yarn-guide-eye 9 is controlled in such a manner that the balloon-yarn-guide-eye 9 is initially displaced out of its resting position RS into an advantageous operating position $AP_1$. Later, the balloon-yarn-guide-eye is transferred into an optimal operating position $AP_2$, wherein at almost the same time, by means of the yarn-tension influencing device 22, for example, a yarn-supply unit, the yarn tension of the outer yarn 5 is increased somewhat, and accordingly, a yarn balloon B3 with an optimal diameter D3 is created.

During the course of the adjustment operations for the optimisation of the yarn balloon B, a plurality of operating positions relative to the operating positions of the balloon-yarn-guide-eye 9, which are disposed between the first operating position $AP_1$ and the second operating position $AP_2$, are, of course, also obtained.

FIG. 8 shows schematically in a lateral view a workstation 1 of a two-for-one twisting machine. The workstation 1 comprises, inter alia, a spindle 2 constituted as a yarn-twisting spindle with a protective pot 19 for the accommodation of at least one feed bobbin 15, a rotatably mounted yarn-deflection device 8 and a vertically adjustable balloon-yarn-guide-eye 9.

In this context, the balloon-yarn-guide-eye 9 can be positioned by a drive device 29, which is connected to a control device 20, optionally in a resting position RS or in one of the operating positions $AP_1$ and $AP_2$ or respectively intermediate positions.

As is evident, a yarn-tension sensor 24, a yarn-supply unit 31 and a drive device 30 for the spindle 2 or respectively its yarn-deflection device 8 are also connected to the control device 20.

A yarn 28 withdrawn from a feed bobbin 15 is introduced from above into a hollow rotary axle of the yarn-deflection device 8 arranged in the region of a rotational axis 35 of the spindle 2 and passes through the yarn-supply unit 31.

The yarn 28 leaves the hollow rotary axle through a so-called yarn discharge borehole facing radially outwards, arranged somewhat below a protective pot 19, and reaches the outer region of the yarn-deflection device 8.

The yarn 28 is deflected upwards, as conventionally, at the yarn-deflection unit 8 and, forming a yarn balloon B1, arrives at the balloon-yarn-guide-eye 9, which, at this time, that is, when the spindle 2 has reached operating speed or also before, is positioned in the resting position RS.

The yarn to 28, which is constituted as a double yarn, travels via a yarn-conveying device 11 to a spooling and winding device 12, where the twisted yarn is wound onto a take-up bobbin 14.

In the present exemplary embodiment, the spindle 2 comprises an indirect drive device 30. That is, the yarn-deflection device 8 comprises a pulley 32 which is charged by a drive belt 33, which also runs over a drive pulley 34 of, for example, a machine-length drive shaft 36. The drive shaft 36 is connected, for example, via a belt drive 37 to a drive 38.

As soon as a measuring device 21 connected to the drive 38, which monitors, for example, the energy consumption of the drive 38, registers, for example, that the spindle 2 is running at the operating speed, a measured value i is sent to the control device 20, which then ensures that the drive device 29 transfers the balloon-yarn-guide-eye 9 out of the resting position RS into an operating position $AP_1$.

In order further to increase the profitability of the two-for-one twisting machine, following the displacement of the balloon-yarn-guide-eye 9 into the operating position $AP_1$ by means of the yarn-supply unit 31, the yarn tension of the folded yarn 28 circulating as the yarn balloon B2 is increased and, at the same time, the balloon-yarn-guide-eye 9 is transferred into an optimal operating position $AP_2$, wherein a yarn balloon B3 with an optimal diameter D3 is created.

During the course of the transfer of the balloon-yarn-guide-eye 9 out of the operating position $AP_1$ into the operating position $AP_2$, a plurality of other operating positions which are disposed between the operating position $AP_1$ and the operating position $AP_2$ are, of course, also obtained.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. An individual workstation of a two-for-one twisting or cabling machine which comprises a rotatably mounted spindle and a balloon-yarn-guide-eye height-adjustable by a drive, characterized in that, the drive is coupled to a control device, which controls the drive in such a manner that it displaces the balloon-yarn-guide-eye between operating positions dependent upon production parameters and a resting position advantageous in the case of production interruptions and transient operating phases associated with the latter, and that a device for detecting a measured value (i) is present, which is made available to the control device and causes the control of the drive to change the position of the balloon-yarn-guide-eye, wherein the balloon-yarn-guide-eye is separately controlled by the individual workstation.

2. The workstation of a two-for-one twisting or cabling machine according to claim 1, characterized in that the device for detecting a measured value (i) is a measuring device, which monitors the energy consumption of the spindle drive during the operation of the workstation.

3. The workstation of a two-for-one twisting or cabling machine according to claim 1, characterized in that the device for detecting a measured value (i) is a time-measuring device.

4. The workstation of a two-for-one twisting or cabling machine according to claim 1, characterized in that, as the device for detecting a measured value (i), a sensor device is used, which detects the size of the yarn balloon (B) circulating around the spindle during the operation of the workstation.

5. The workstation of a two-for-one twisting or cabling machine according to claim 1, characterized in that the device for detecting a measured value (i) is a yarn-tension sensor.

6. The workstation of a two-for-one twisting or cabling machine according to claim 1, characterized in that a controllable yarn-tension influencing device is installed in the region of the yarn pathway of a balloon yarn.

7. The workstation of a two-for-one twisting or cabling machine according to claim 6, characterized in that the yarn-tension influencing device is constituted as a yarn-supply unit.

8. The workstation of a two-for-one twisting or cabling machine according to claim 6, characterized in that the yarn-tension influencing device is constituted as a yarn brake, with which the yarn tension of the balloon yarn is adjustable.

9. The workstation of a two-for-one twisting or cabling machine according to claim 1, characterized in that the control device is constituted in such a manner that signals which are related to a given event in the relevant workstation are used for a defined control of the drive of the balloon-yarn-guide-eye and its positioning in an associated operating position or a resting position.

10. The workstation of a two-for-one twisting or cabling machine according to claim 1, characterized in that the control device is constituted in such a manner that, during the operation of the workstation, it ensures that, in order to reduce the energy consumption of the spindle drive, the balloon-yarn-guide-eye is displaced from a first operating position into a second operating position.

11. The workstation of a two-for-one twisting or cabling machine according to claim 1, characterized in that a second operating position of the balloon-yarn-guide-eye is arranged between a first operating position and the resting position of the balloon-yarn-guide-eye.

12. The workstation of a two-for-one twisting or cabling machine according to claim 9, wherein the given event is a spindle start, yarn breakage, end of running period, or batch change.

* * * * *